US005561405A

United States Patent [19]

Hoffmeister et al.

[11] Patent Number: 5,561,405

[45] Date of Patent: Oct. 1, 1996

[54] VERTICAL GROUNDED COPLANAR WAVEGUIDE H-BEND INTERCONNECTION APPARATUS

[75] Inventors: Richard M. Hoffmeister, Harbor City; Clifton Quan, Arcadia, both of Calif.

[73] Assignee: Hughes Aircraft Company, Los Angeles, Calif.

[21] Appl. No.: 463,327

[22] Filed: Jun. 5, 1995

[51] Int. Cl.[6] ..... H01P 5/00

[52] U.S. Cl. ..... 333/34; 333/246; 333/260

[58] Field of Search ..... 333/33, 34, 238, 333/246, 260

[56] References Cited

U.S. PATENT DOCUMENTS

| | | | |
|---|---|---|---|
| 2,790,148 | 4/1957 | Kostriza | 333/33 X |
| 3,093,805 | 6/1963 | Osifchin et al. | 333/238 X |
| 3,573,670 | 4/1971 | Skobern | 333/33 |
| 4,429,289 | 1/1984 | Higgins, Jr. et al. | 333/246 X |
| 5,200,719 | 4/1993 | Margulis et al. | 333/34 |
| 5,294,897 | 3/1994 | Notani et al. | 333/246 X |

FOREIGN PATENT DOCUMENTS

| | | | |
|---|---|---|---|
| 80601 | 4/1991 | Japan | 333/33 |

*Primary Examiner*—Paul Gensler

*Attorney, Agent, or Firm*—Leonard A. Alkov; Wanda K. Denson-Low

[57] ABSTRACT

Interconnection apparatus providing a right angle H-plane bend in grounded coplanar waveguide (GCPW) transmission line media. Respective first and second GCPW lines include a dielectric substrate, on which is formed on a bottom surface a bottom conductive ground plane, and on a top surface is formed a center conductor strip sandwiched between first and second top ground plane strips. The two GCPW lines are disposed orthogonally, forming a corner junction at which corresponding bottom and top ground planes, and the center conductor strips, of the lines are electrically connected. The gaps between corresponding top ground plane strips and the center conductor strips have regions of increased gap width at the corner junction to compensate for the capacitance resulting from the junction.

21 Claims, 2 Drawing Sheets

VERTICAL GROUNDED COPLANAR WAVEGUIDE H-BEND INTERCONNECTION APPARATUS

TECHNICAL FIELD OF THE INVENTION

This invention relates to RF transmission lines, and more particularly to a transmission line interconnect including a right angle grounded coplanar waveguide H-bend.

BACKGROUND OF THE INVENTION

Grounded coplanar waveguide (GCPW) transmission line is a type of media used in many RF applications. Most GCPW right angle bends occur within a single plane, e.g., a horizontal plane. Conventionally, vertical bends require the transition from a GCPW to another transmission line (such as a coaxial line).

Conventionally, circuit boards have been interconnected with cables or ribbons. The disadvantages to these conventional interconnect techniques include excessive size, weight and cost.

SUMMARY OF THE INVENTION

This invention offers a new, compact approach to microwave packaging. Separate, individual hybrid circuit board assemblies can now be packaged vertically, saving valuable real estate.

A vertical grounded coplanar waveguide (GCPW) H-bend interconnect apparatus is described, and includes a first GCPW transmission line, comprising a first dielectric substrate having first and second opposed surfaces, a bottom conductive ground plane defined on the first dielectric surface, and a center conductor strip defined on the second surface in a spaced relationship with first and second top conductive ground plane strips. The interconnect apparatus further includes a second GCPW transmission line, comprising a second dielectric substrate having third and fourth opposed surfaces, a second bottom conductive ground plane defined on the third dielectric surface, and a second center conductor strip defined on the fourth surface in a spaced relationship with third and fourth top conductive ground plane strips. The second substrate is disposed transversely to the first substrate and in contact with the first substrate such that the first and second center conductor strips are aligned and in electrical contact, the first and third top ground plane strips are aligned and in electrical contact, and the second and fourth top ground plane strips are aligned and in electrical contact.

The first and third top ground plane conductor strips, and the second and fourth top ground plane conductor strips, are respectively electrically connected along a corner junction between the first and second GCPW transmission lines. In a preferred embodiment, the gaps between respective top ground plane conductor strips and the center conductor strip are increased in size at regions adjacent the corner junction to compensate for capacitive coupling at the junction.

BRIEF DESCRIPTION OF THE DRAWING

These and other features and advantages of the present invention will become more apparent from the following detailed description of an exemplary embodiment thereof, as illustrated in the accompanying drawings, in which.

FIGS. *2a–2c* are schematic diagrams showing three different alternate embodiments of the shaping of the H-bend junction groundplane cutouts to improve performance of the GCPW bend.

Figure 3:
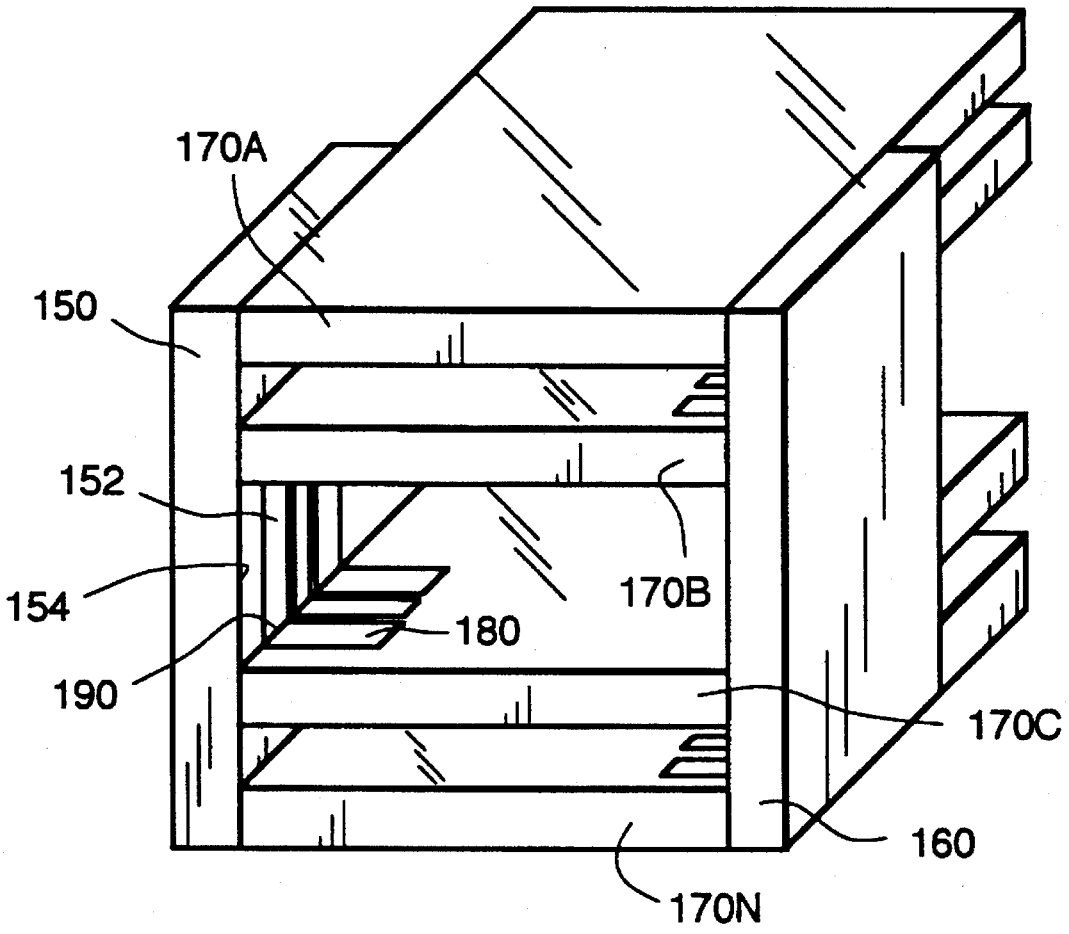

FIG. 3 is an isometric view illustrating an exemplary application of the invention.

DETAILED DESCRIPTION OF THE PREFERRED EMBODIMENTS

Figure 1:
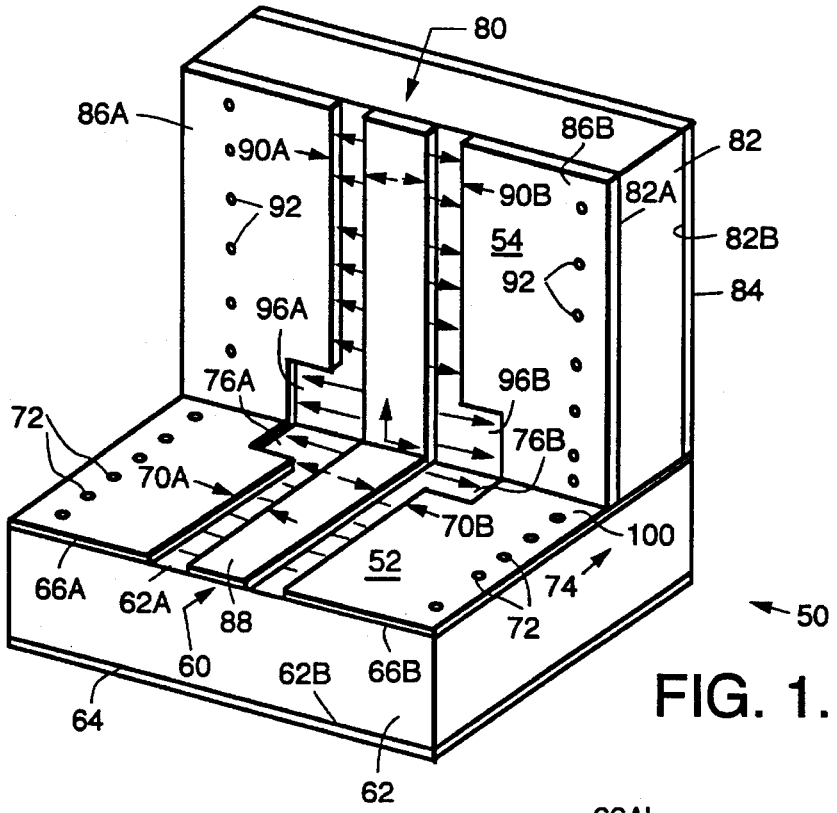
FIG. 1 is an isometric view of a vertical, right angle GCPW bend embodying the invention.

FIG. 1 is an isometric view of a vertical, right angle, grounded coplanar waveguide (GCPW) bend interconnect circuit 50 embodying this invention. Conventionally, most GCPW right angle bends occur within a single plane. This interconnect circuit 50 provides a transition from a GCPW 60 in a horizontal plane 52 to a GCPW 80 in a vertical plane 54 without the need of an intermediate interconnect. The two GCPWs 60 and 80 are placed at right angles, forming a vertical, right angle GCPW H-bend. This can be extended to form interconnects between a stacked assembly of microwave hybrids.

The horizontal GCPW 60 comprises a planar dielectric substrate 62 having opposed planar surfaces 62A and 62B. A GCPW bottom ground plane 64 is defined by a metal layer applied to the lower surface 62B. A center conductor strip 68 is defined on the top surface 62A between first and second top ground planes 66A and 66B, also formed on the top surface 62A. The top ground planes are separated from the center conductor strip by gaps 70A and 70B. A plurality of plated through holes 72 are formed in the substrate 62 to provide electrical ground connection between the bottom ground plane 64 and the top ground planes 66A and 66B. In some embodiments, the GCPW lines will not include the bottom ground plane layer, in which case it will be unnecessary to provide the interconnection between the top and bottom ground plane layers.

The vertical GCPW 80 comprises a planar dielectric substrate 82 having opposed planar surfaces 82A and 82B. A GCPW bottom ground plane 84 is defined by a metal layer applied to the lower surface 82B. A center conductor strip 88 is defined on the top surface 82A between first and second top ground planes 86A and 86B, also formed on the top surface 82A. The top ground planes are separated from the center conductor strip by gaps 90A and 90B. A plurality of plated through holes 92 are formed in the substrate 82 to provide electrical ground connection between the bottom ground plane 84 and the top ground planes 86A and 86B.

The two GCPWs 60 and 80 are connected together at a right angle with the top ground plane strips and center conductor strips of the two GCPWs respectively electrically connected together, e.g., by conductive epoxy. This forms a right angle corner interconnection 100 between the top surfaces of the two GCPWs. A section of conductive strips is removed from the horizontal GCPW substrate 62 to expose the dielectric at region 74, and the vertical GCPW substrate 82 is placed on top of this exposed dielectric. The sharp corner of the interconnection 100 will have a great deal of capacitance associated with it, so the corners 76A, 76B, 96A, 96B of the ground planes 66A, 66B, 86A, 86B near the vertical transition 100 are relieved or cut out to increase the gap size between the center and top ground plane conductor strips to help compensate for the capacitance.

In an exemplary embodiment, the GCPWs 60 and 80 have a center conductor width of 20.96 mils, a gap size (70A, 70B) of 10 mils, and a 40 mil thick substrate of RT/6010

Duroid (TM) ($\epsilon_r$=10.2). The plated through via holes 72 and 92 have a diameter of 13 mils, centered at a distance of 75 mils from the center of the center conductor strip 68 and 88.

Attachment of the two transmission lines 60 and 80 can also be accomplished with reflowed solders, solder bumps, z-axis adhesives, as long as there is DC continuity between the corresponding conductor lines.

Figure 2A:
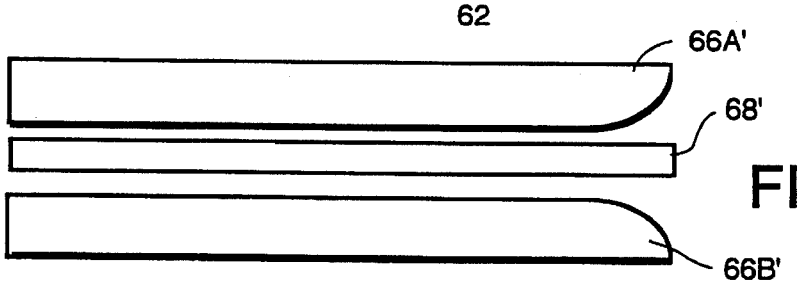
Figure 2B:
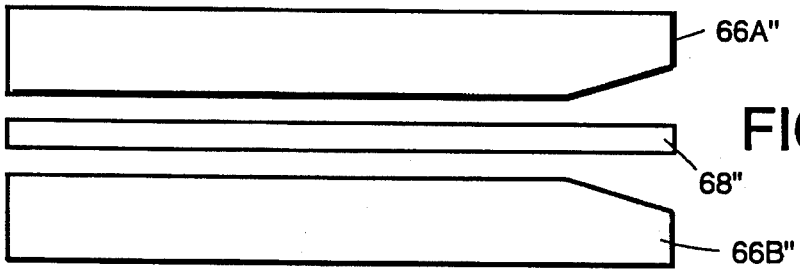
Figure 2C:
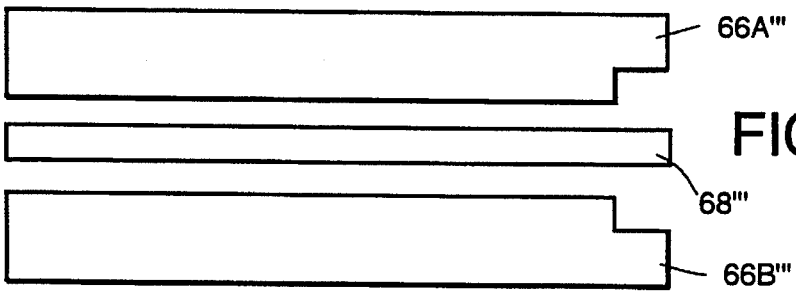

Analysis shows that reshaping of the H-bend junction will increase the operating bandwidth and improve the performance. FIGS. 2*a*–2*c* illustrate three respective different configurations of the ground plane cutouts at the H-bend junction. FIG. 2*a* illustrates a GCPW center conductor 68' and ground plane conductors 66A' and 66B', wherein the ground plane conductors have flare-out end configurations which are gradual exponential tapers. FIG. 2*b* illustrates a GCPW line configuration including center conductor 68" and ground plane conductors 66A" and 66B", wherein the latter conductors have ground plane flare-outs which are gradual linear tapers. FIG. 2*c* illustrates a GCPW line configuration including the center conductor 68'" with ground plane conductors 66A'" and 66B'", wherein the latter conductors have abrupt step cutouts at the ends thereof. All of the configurations can be used to reshape the H-bend junction cutouts to improve the RF performance.

FIG. 3 is an isometric view illustrating, as an exemplary application for the invention, an arrangement of stacked microwave integrated circuits (MICs) realized with vertical GCPW H-bend connections in accordance with the invention. Here, two printed wiring boards (PWBs) 150 and 160 are arranged in parallel in a vertical orientation. Extending between the PWBs are several MIC boards 170A–170N. Each MIC board has GCPW input/output connections 180 along its edges as indicated in FIG. 3 on exemplary board 170C. Each PWB board 150 and 160 has vertical GCPW circuits extending along the inner facing surfaces of the boards. For example, board 150 has vertical GCPW circuits 152 formed on surface 154. Vertical H-bend interconnects 100 in accordance with the invention, as more particularly shown in FIG. 1, provide microwave frequency interconnection between the GCPW input/output lines of the stacked MIC boards and the vertical GCPW lines 152 of the vertical PWBs. In this exemplary embodiment, the GCPW input/output lines of the stacked MIC boards do not include the bottom ground plane layer. However, such ground planes are desired, and can be interconnected with plated through holes formed in the dielectric substrates to the corresponding top ground plane strips on the stacked boards, and also to corresponding bottom ground plane strips for the GCPW lines 152 of the vertical PWBs.

This invention need not be restricted to two PWBs as illustrated in FIG. 3. For example, one vertical GCPW can connect several stacked, horizontal boards. It would also be possible to skip any boards where connections are not necessary by sizing the boards appropriately or by cutting sections out of the boards to allow the vertical GCPW to pass by without making contact. Further extensions would allow for multiple GCPWs on each board. This would require one vertical GCPW for each different waveguide on the boards.

Applications for the invention include vertical interconnections between stacked substrates, which can, be found in receiver/exciter circuits, communication subsystems, and other microwave circuitry. Such circuitry can be found in radar systems, satellites, microwave automobile electronics, missile systems, and cellular telephones.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A vertical coplanar waveguide (CPW) H-band interconnect apparatus, comprising:

a first CPW transmission line, comprising a first dielectric substrate having first and second opposed surfaces, and a first center conductor strip defined on said second surface in a spaced relationship with first and second top conductive ground plane strips;

a second CPW transmission line, comprising a second dielectric substrate having third and fourth opposed surfaces, and a second center conductor strip defined on said fourth surface in a spaced relationship with third and fourth top conductive ground plane strips;

said second substrate disposed transversely and adjacent to said first substrate such that said first and second center conductor strips, are aligned and in electrical contact, said first and third top ground plane strips are aligned and in electrical contact, and said second and fourth top ground plane strips are aligned and in electrical contact;

wherein said first and third top ground plane conductor strips, and said second and fourth top ground plane conductor strips, are respectively electrically connected along a corner interconnect junction between said first and second CPW transmission lines, said first center conductor strip is separated from said first and second ground plane strips by respective first and second gaps, said second center conductor strip is separated from said third and fourth ground plane strips by respective third and fourth gaps, and wherein said first, second, third and fourth gaps have regions of increased gap size adjacent said corner interconnection junction to compensate for capacitive coupling at said junction.

2. The apparatus of claim 1 wherein said regions of increased gap size are rectilinear in configuration.

3. The apparatus of claim 1 wherein said regions of increased gap size have a gradual exponential tapered configuration.

4. The apparatus of claim 1 wherein said regions of increased gap size have a gradual linear tapered configuration.

5. The apparatus of claim 1 wherein said first and second CPW transmission lines are disposed orthogonally to each other.

6. A circuit arrangement including at least one printed wiring board (PWB) and at least one microwave integrated circuit (MIC) board arranged orthogonally to the PWB with board-to-board microwave frequency electrical interconnection between the PWB and the MIC board, the PWB including a first dielectric substrate having formed along a first surface center conductor strip and spaced first and second ground plane strips to define a vertical co-planar waveguide (CPW) transmission line, the MIC board including a second dielectric substrate having formed on a third surface a second center conductor strip and spaced third and fourth ground plane strips to define a CPW input/output (I/O) transmission line, an edge of the MIC board in contact with said PWB, and a vertical CPW H-bend interconnection at a junction between said vertical CPW line and said CPW I/O line, said second substrate disposed transversely to said first substrate and in contact with said first substrate such that said first and second center conductor strips are aligned and in electrical contact, said first and third top ground plane strips are aligned and in electrical contact, and said second and fourth top ground plane strips are aligned and in electrical contact, wherein said first and third top ground plane conductor strips, and said second and fourth top ground plane conductor strips, are respectively electrically connected along a corner interconnect junction between said first and second CPW transmission lines, said first center conductor strip is separated from said first and second ground plane strips by respective first and second gaps, said second center conductor strip is separated from said third and fourth ground plane strips by respective third and fourth gaps, and wherein said first, second, third and fourth gaps above regions of increased gap size adjacent said corner interconnection junction to compensate for capacitive coupling at said junction.

7. The apparatus of claim 6 wherein said regions of increased gap size are rectilinear in configuration.

8. The apparatus of claim 6 wherein said regions of increased gap size have a gradual exponential tapered configuration.

9. The apparatus of claim 6 wherein said regions of increased gap size have a gradual linear tapered configuration.

10. A vertical grounded coplanar waveguide (GCPW) H-band interconnect apparatus, comprising:

a first GCPW transmission line, comprising a first dielectric substrate having first and second opposed surfaces, a bottom conductive ground plane defined on said first dielectric surface, and a first center conductor strip defined on said second surface in a spaced relationship with first and second top conductive ground plane strips;

a second GCPW transmission line, comprising a second dielectric substrate having third and fourth opposed surfaces, a second bottom conductive ground plane defined on said third dielectric surface, and a second center conductor strip defined on said fourth surface in a spaced relationship with third and fourth top conductive ground plane strips;

said second substrate disposed transversely to said first substrate and in contact with said first substrate such that said first and second center conductor strips are aligned and in electrical contact, said first and third top ground plane strips are aligned and in electrical contact, said second and fourth top ground plane strips are aligned and in electrical contact;

wherein said first and third top ground plane conductor strips, and said second and fourth top ground plane conductor strips, are respectively electrically connected along a corner interconnect junction between said fist and second GCPW transmission lines, said first center conductor strip is separated from said first and second ground plane strips by respective first and second ground plane strips by respective first and second gaps, said second center conductor strip is separated from said third and fourth ground plane strips by respective third and fourth gaps, and wherein said first, second, third and fourth gaps have regions of increased gap size adjacent said corner interconnection junction to compensate for capacitive coupling at said junction.

11. The apparatus of claim 10 wherein said regions of increased gap size are rectilinear in configuration.

12. The apparatus of claim 10 wherein said regions of increased gap size have a gradual exponential tapered configuration.

13. The apparatus of claim 10 wherein said regions of increased gap size have a gradual linear tapered configuration.

14. The apparatus of claim 12 wherein said first and second GCPW transmission lines are disposed orthogonally to each other.

15. The apparatus of claim 12 further comprising a plurality of conductive plated through holes formed through said respective first and second dielectric substrates and forming an electrical connection between said bottom ground planes and said top ground plane strips, so that said top ground plane strips of each GCPW are in electrical contact with said corresponding bottom ground plane.

16. The apparatus of claim 12 wherein said first bottom conductive ground plane is in electrical contact with said second bottom conductive ground plane.

17. A circuit arrangement including at least one printed wiring board (PWB) and at least one microwave integrated circuit (MIC) board arranged orthogonally to the PWB with board-to-board microwave frequency electrical interconnection between the PWB and the MIC board, the PWB including a first dielectric substrate having formed along a first surface center conductor strip and spaced first and second ground plane strips and on a second dielectric surface a first bottom ground plane to define a vertical grounded coplanar waveguide (GCPW) transmission line, the MIC board including a second dielectric substrate having formed on a third surface a second center conductor strip and spaced third and fourth ground plane strips and on a fourth surface a second bottom ground plane surface to define a GCPW input/output (I/O) transmission line, an edge of the MIC board in contact with aid PWB, and a vertical GCPW H-bend interconnection at a junction between said vertical GCPW line and said CPW I/O line, said second substrate disposed transversely to said first substrate and in contact with said first substrate such that said first and second center conductor strips are aligned and in electrical contact, said first and third top ground plane strips are aligned and in electrical contact, said second and fourth top ground plane strips are aligned and in electrical contact, wherein said first and third top ground plane conductor strips, and said second and fourth top ground plane conductor strips, are respectively electrically connected along a corner interconnect junction between said first and second GCPW transmission lines, said first center conductor strip is separated from said first and second ground plane strips by respective first and second gaps, said second center conductor strip is separated from said third and fourth ground plane strips by respective third and fourth gaps, and wherein said first, second, third and fourth gaps have regions of increased gap size adjacent said corner interconnection junction to compensate for capacitive coupling at said junction.

18. The apparatus of claim 17 wherein said regions of increased gap size are rectilinear in configuration.

19. The apparatus of claim 17 wherein said regions of increased gap size have a gradual exponential tapered configuration.

20. The apparatus of claim 17 wherein said regions of increased gap size have a gradual linear tapered configuration.

21. The apparatus of claim 17 further comprising a plurality of conductive plated through holes formed through said respective first and second dielectric substrates and forming an electrical connection between said bottom ground planes and said top ground plane strips, so that said top ground plane strips of each GCPW are in electrical contact with said corresponding bottom ground plane.

* * * * *